US006712498B1

(12) United States Patent
Yang

(10) Patent No.: US 6,712,498 B1
(45) Date of Patent: Mar. 30, 2004

(54) STRADDLE MIXER

(76) Inventor: Li-Chin Yang, No. 68, Renyi Rd., Wufeng Shiang, Taichung City (TW)

( * ) Notice: Subject to any disclaimer, the term of this patent is extended or adjusted under 35 U.S.C. 154(b) by 0 days.

(21) Appl. No.: 10/232,378

(22) Filed: Sep. 3, 2002

(51) Int. Cl.[7] ..... B01F 7/22
(52) U.S. Cl. ..... 366/282
(58) Field of Search ..... 366/65, 66, 96–98, 366/279, 281–284, 342–343

(56) References Cited

U.S. PATENT DOCUMENTS

| | | | | |
|---|---|---|---|---|
| 1,449,051 A | * | 3/1923 | Mitchell | 366/282 |
| 1,983,788 A | * | 12/1934 | Brennan | 366/282 |
| 2,571,366 A | * | 10/1951 | Jennings | 366/282 |
| 6,135,630 A | * | 10/2000 | O'Neill | 368/281 |

FOREIGN PATENT DOCUMENTS

| | | | |
|---|---|---|---|
| DE | 3704371 A1 | * | 8/1987 |

* cited by examiner

*Primary Examiner*—Charles E. Cooley
(74) *Attorney, Agent, or Firm*—Birch, Stewart, Kolasch & Birch, LLP

(57) ABSTRACT

A straddle mixer includes a motor driving a spindle, a base dock located below the motor having sleeves located on a bottom side thereof to couple with rods, and a clamp apparatus mounted onto the rods. The clamp apparatus includes a stationary plank connected to one end of the rods and a movable plank movably coupled with another end of the rods, and an anchor block fastened to another end of the rods on an outer side of the movable plank. A screw rod runs through the anchor block and may be turned to move the movable plank to enable the clamp apparatus to clamp a paint drum for positioning and anchoring. The spindle has a lower end coupled with a chuck to connect a blender. The blender is detachable for cleaning.

4 Claims, 8 Drawing Sheets

STRADDLE MIXER

FIELD OF THE INVENTION

The present invention relates to an apparatus for blending coating materials and particularly a straddle mixer that is adjustable to suit paint drums of different sizes and fastenable to the paint drum, and has a detachable blender to facilitate washing and cleaning.

BACKGROUND OF THE INVENTION

A conventional paint or coating material mixer such as the one shown in FIG. 1 mainly includes a small driving motor 1 which has a spindle extended to form a center stem 2. The center stem 2 has a lower end coupled with one or more blades 3 which may be driven to rotate by the motor 1. The top end and one side of the motor 1 have respectively a handle ring 4 and a handgrip 5 to enable an user to grasp with two hands for placing the lower end of the center stem 2 into a paint drum to mix the paint contained therein with the rotating blades 3 when the motor 1 is activated. In practical use, paints and coating materials usually have a relatively high viscosity, and a painter usually has to estimate in advance the required paint for a given painting area, and blends the required paint of a desired color in one batch to avoid blending in different batches and result in different painting color hues. However, the conventional paint mixer mentioned above is suitable only for blending a small amount of paint. This is mainly caused by the constraints of human labor and the sizes of the handle ring and handgrip. As the motor is made from metal and is quite heavy, and the paint has a great viscosity, it is difficult for a painter to grasp and hold the paint mixer for a long period of time or to blend a large amount of paint. This is a problem pending to be resolved.

SUMMARY OF THE INVENTION

Therefore the primary object of the invention is to provide a straddle mixer that has a larger driving motor mounted onto a horizontal base dock. There is a clamp apparatus with an adjustable clamping width located beneath the base dock for fastening to the upper rim of a paint drum. The clamp apparatus also enables a blender to move to thoroughly blend the paint.

Another object of the invention is to provide a chuck below the motor that is movable to grip or detach the blender so that the paint drum may be cleaned easily and the blender may be detached or replaced conveniently.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
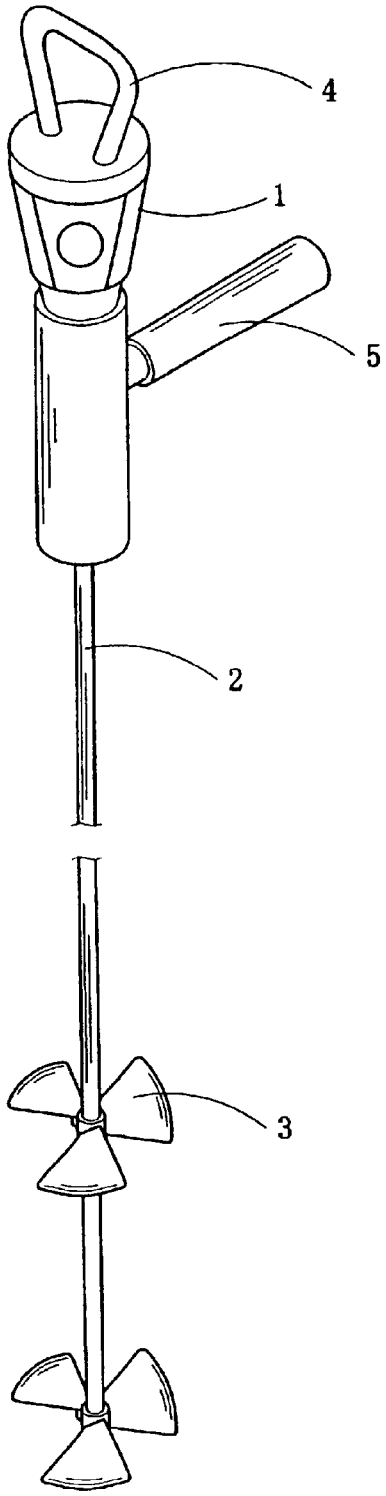
PRIOR ART FIG. 1
FIG. 1 is a perspective view of a conventional mixer.
Figure 2:
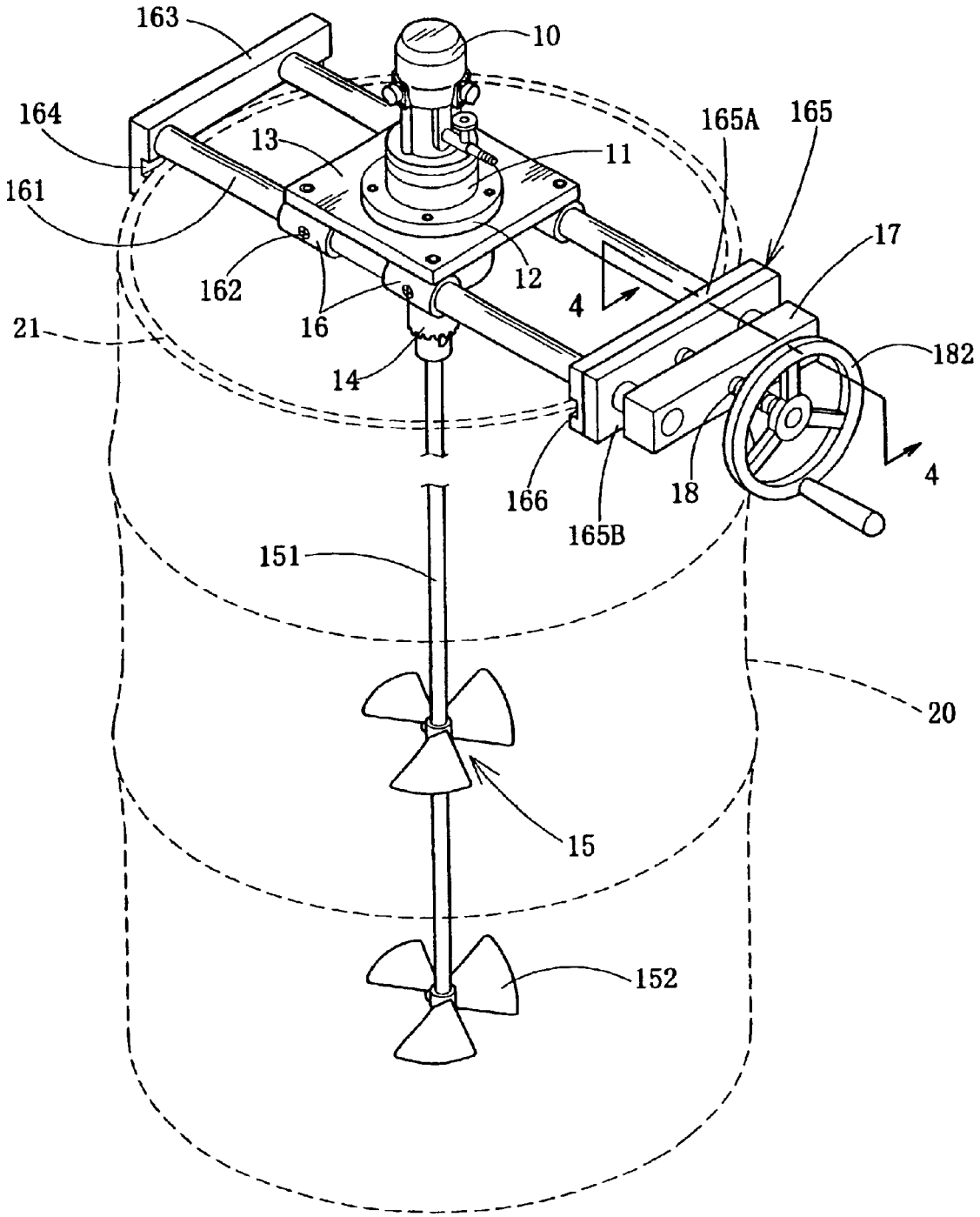
FIG. 2 is a perspective view of an embodiment of the invention in use.
Figure 3:
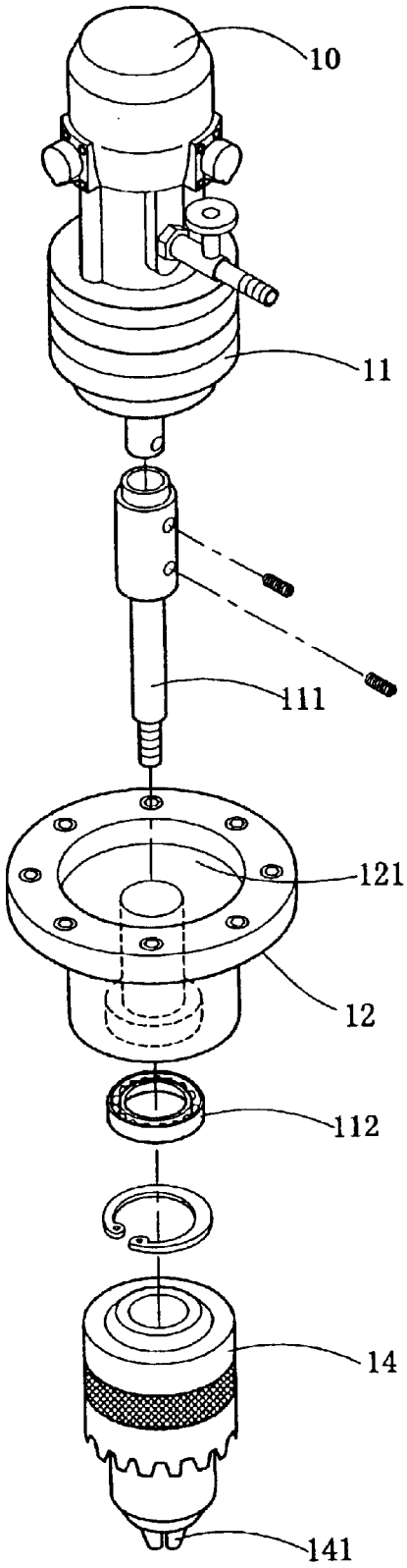
FIG. 3 is an exploded view of an embodiment of the invention.
Figure 5:
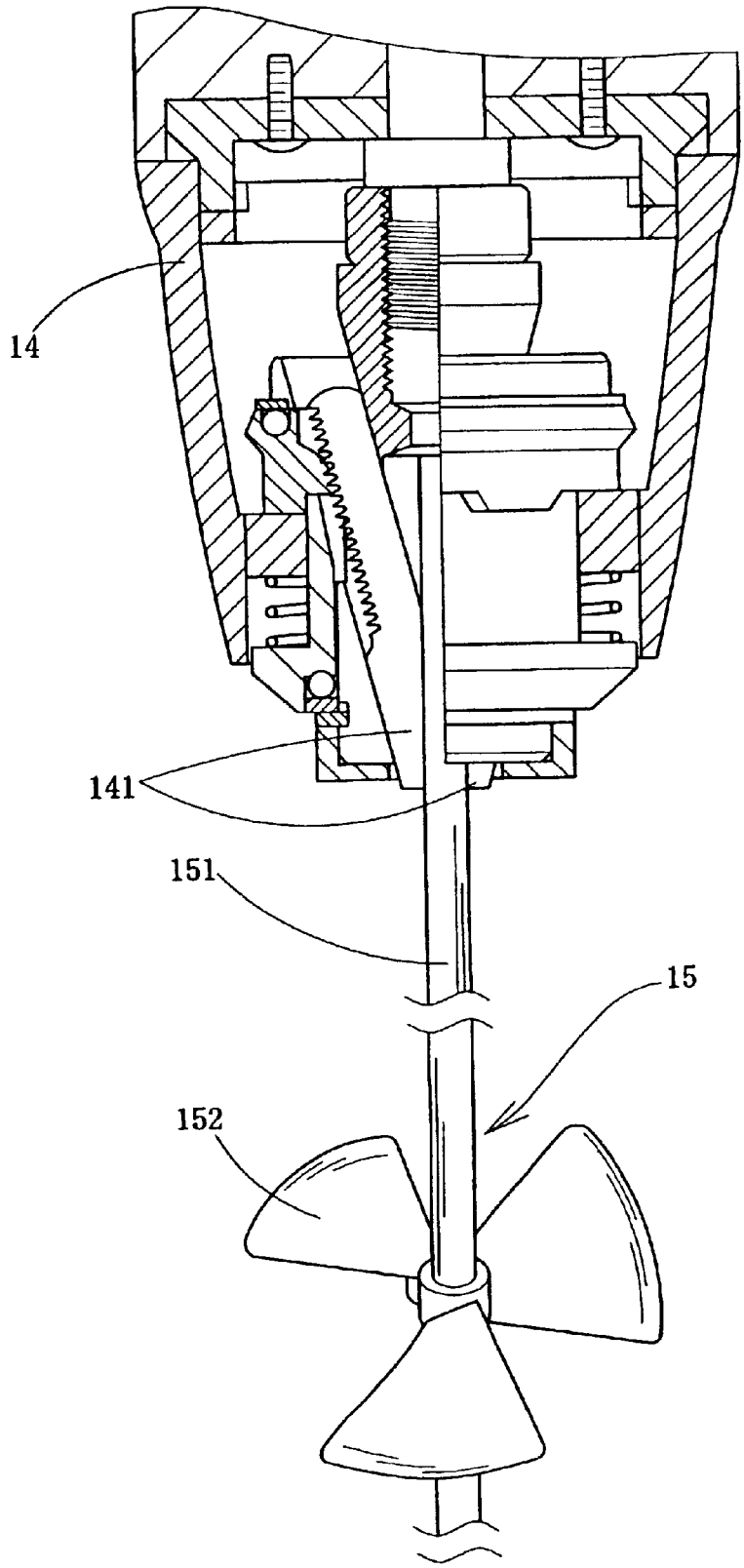
FIG. 5 is a fragmentary cross section of an embodiment of a chuck of the invention.

Referring to FIGS. 2 and 3, the straddle mixer of the invention includes a vertical air motor 10 and a speed reducer 11 connecting to a lower end of the motor 10. Below the speed reducer 11, there is a hollow coupling barrel 12 housed in an opening formed on a horizontal base dock 13. The hollow coupling barrel 12 has a peripheral flange fastened to the base dock 13 around the opening. The upper end of the coupling barrel 12 has a cavity 121 directing downwards to house the lower section of the speed reducer 11. The coupling barrel 12 has a center hole to allow a spindle 111 that fastened to the lower end of the speed reducer 11 to pass through. There is a bearing 112 located between the spindle 111 and the coupling barrel 12. The spindle 111 has a lower end fastened to a round chuck 14. Referring to FIG. 5, the chuck 14 has three jaws 141 located at the lower end. The jaws 141 are retractable synchronously towards the center to grip the stem 151 of a blender 15.

The stem 151 of the blender 15 has two blade units 152 mounted onto a lower end thereof for blending paint or coating materials.

Figure 4:
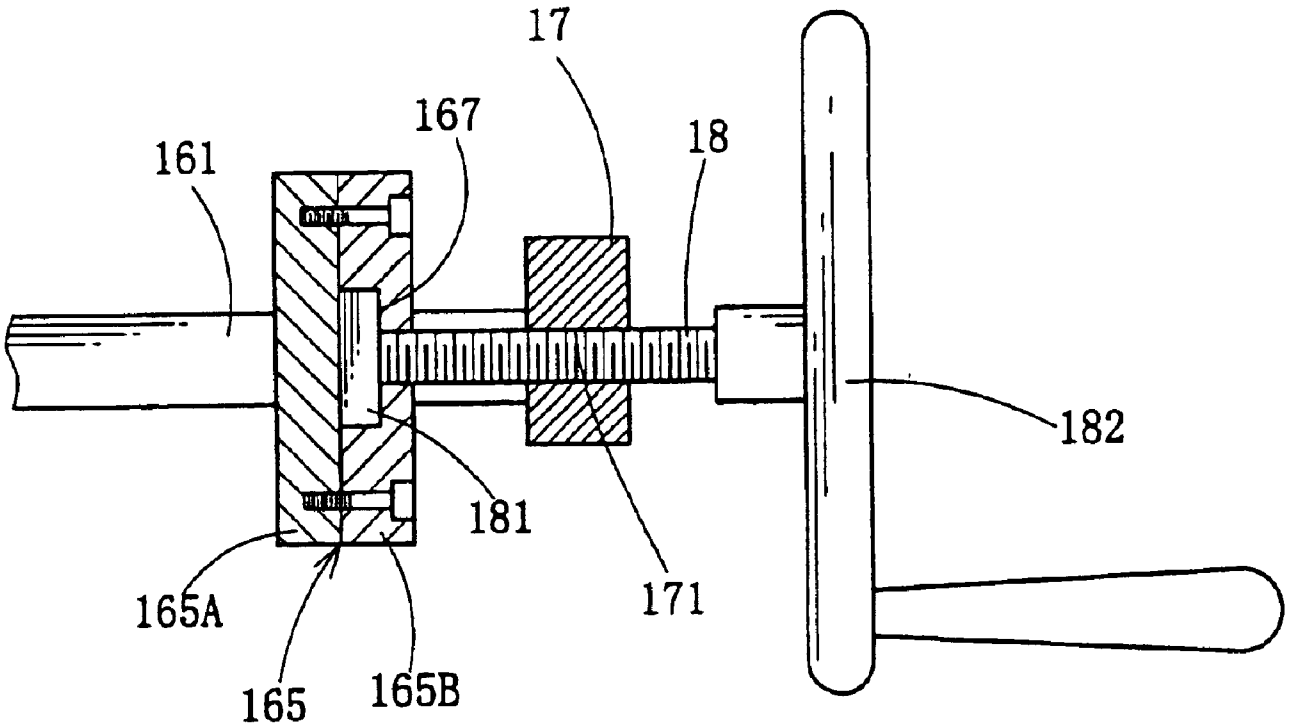
FIG. 4 is a cross section taken along line 4—4 in FIG. 2.
Figure 6A:
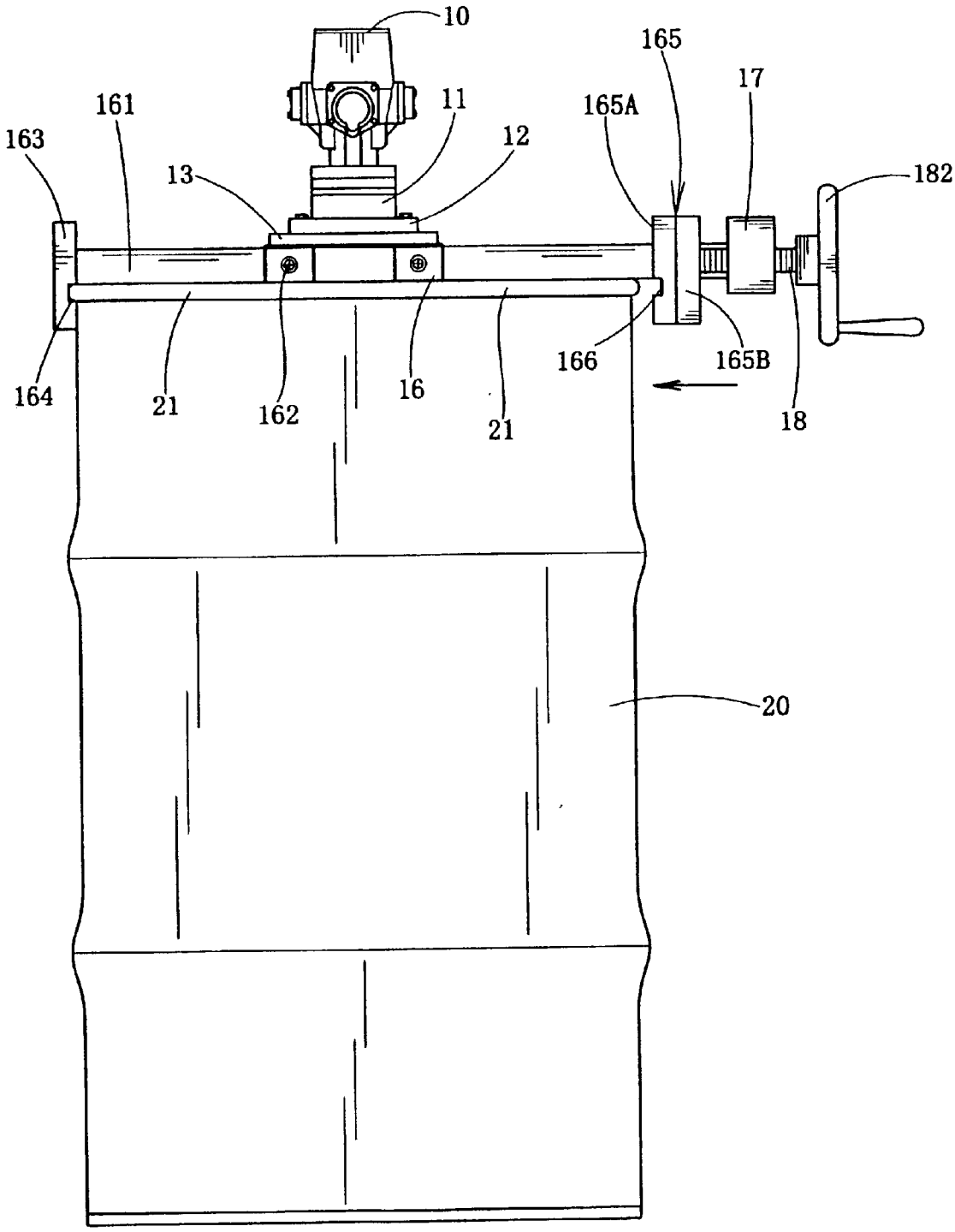
FIG. 6A is a schematic view of an embodiment of the invention in an operating condition.
Figure 6B:
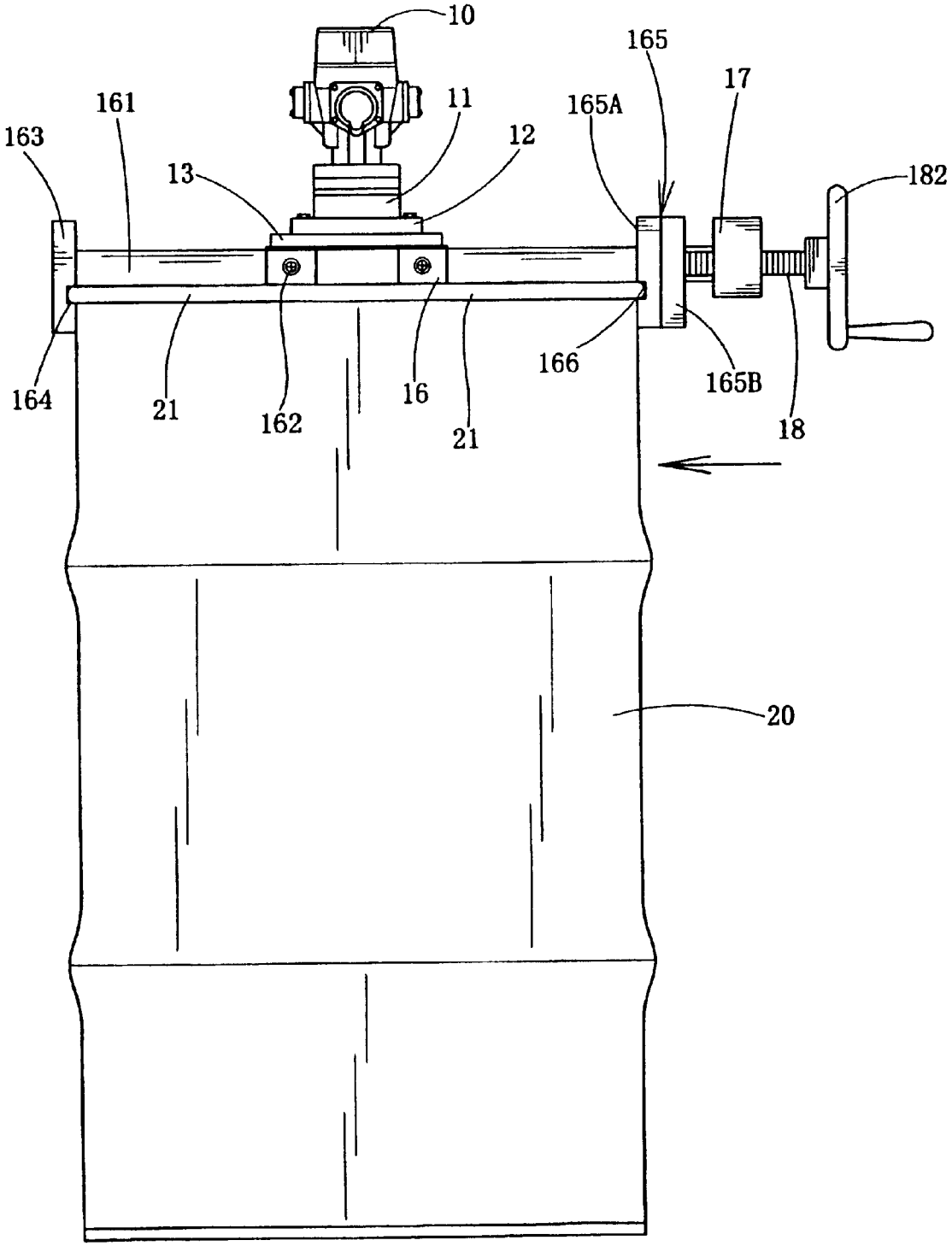
FIG. 6B is a schematic view of an embodiment of the invention in another operating condition.

The horizontal base dock 13 has two sleeves 16 located respectively at a front side and a rear side on a lower section thereof to couple with a rod 161. Each sleeve 16 is engaged with a set screw 162 from the outer wall for fastening the rod 161 securely in the sleeve 16. There is a clamp apparatus mounting onto the two rods 161. The clamp apparatus includes a stationary plank 163 located at one end of the rods 161 that has a first groove 164 formed on an inner wall surface to engage with a top peripheral rim 21 of a paint drum 20. The clamp apparatus has a movable plank 165 movably run through by another end of the rods 161. Referring to FIG. 4, the movable plank 165 includes a front plank 165A and a rear plank 165B that are fastened together by screws. The front plank 165A has an inner wall surface with a second groove 166 formed thereon. The rear plank 165B has a fish eye cavity 167 formed in the axial direction. There is an anchor block 17 fastened to anther end of the rods 161. There is a screw rod 18 coupling with a middle screw hole 171 formed on the anchor block 17. The screw rod 18 has one end formed a retain flange 181 which is greater than the outer diameter of the screw rod 18 and another end running through the fish eye cavity 167 of the rear plank 165B to fasten to a wheel 182. Turning the wheel 182, the screw rod 18 may be driven to rotate. Then the retain flange 181 at one end of the screw rod 18 may push the front plank 165A moving towards the stationary plank 163 or drive the rear plank 165B moving the entire movable plank 165 towards the anchor block 17 as shown in FIGS. 6A and 6B.

By means of the construction set forth above, when in use, first select a suitable blender 15 to be gripped by jaws 141 of the chuck 14. Fasten the jaws 141 tightly to enable the stem 151 of the blender 15 be fastened securely below the horizontal base dock 13. The movable plank 165 of the invention may be adjusted to the left or right side to suit the size of the paint drum 20. For operation, place the invention on the top of the paint drum 20 in a straddle manner with the first groove 164 of the stationary plank 163 located at one end of the base dock 13 to wedge and engage with the top peripheral rim 21 of the paint drum 20, then turn the wheel 182 to move the movable plank 165 towards the top peripheral rim 21 at another side of the paint drum 20 to enable the second groove 166 on the movable plank 165 to engage tightly with the top peripheral rim 21 at another side. Then move the blade units 152 at the lower end of the blender 15 into the paint drum 20. The set screw 162 on the sleeve 16 may be loosened to adjust the left and right position of the horizontal base dock 13, and be fastened again to station the blender 15 at a desired location in the paint drum 20. Then the motor of a greater power may be activated to blend a large amount of paint or coating materials. Thus the invention can save human labor and overcome the problem of hand gripping limitation that occurs to conventional mixers. The invention also can blend a large amount of paint and resolve the problem of blending paint in multiple batches that result in different color hues.

Figure 7:
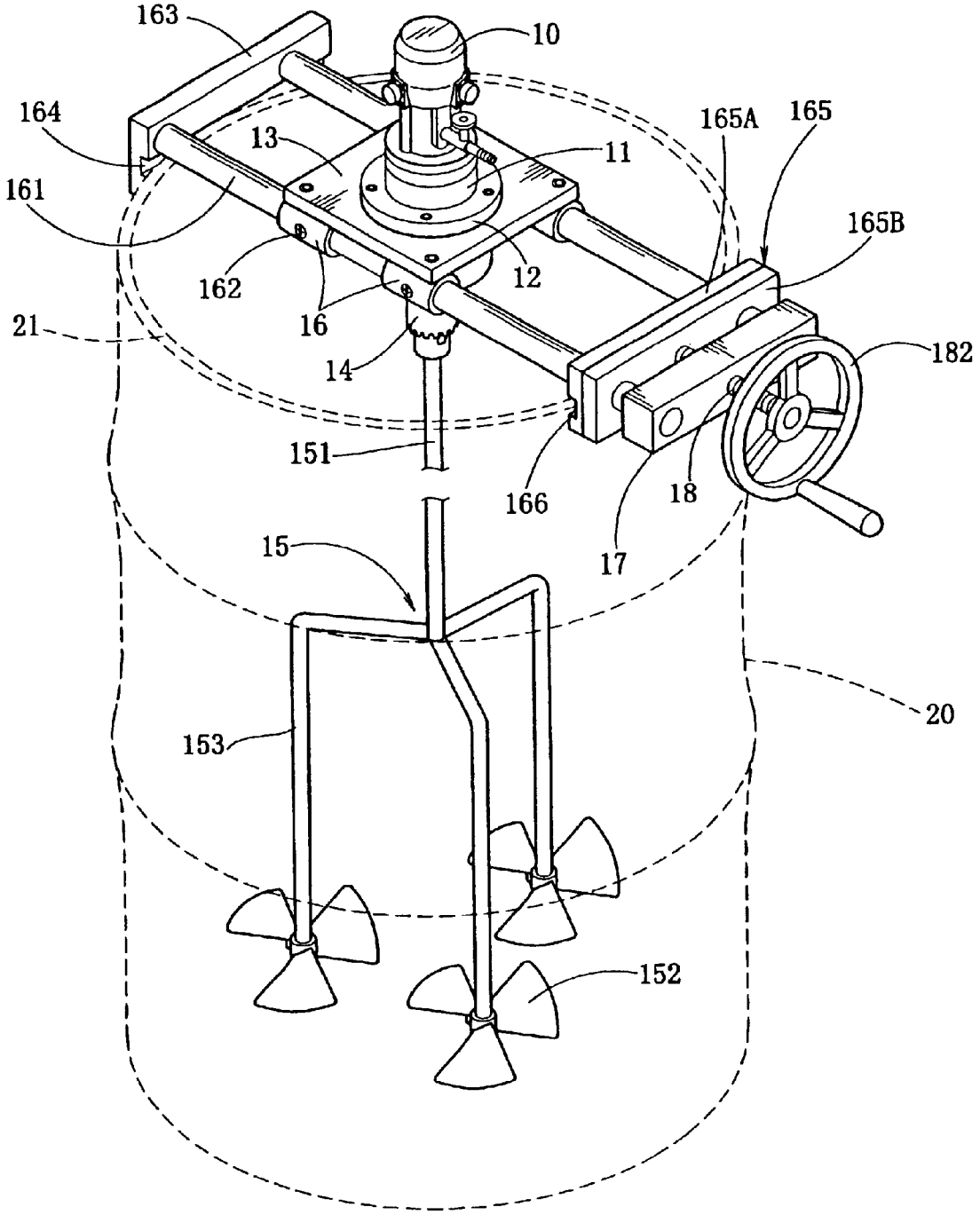
FIG. 7 a perspective view of another embodiment of the invention.

In addition, the three jaws 141 of the chuck 14 can grip or loosen the blender. Therefore different types of blenders 15 with different number and size of stems 153 and blade units 152 (referring to FIG. 7) may be selected and coupled with the chuck 14 to meet various blending requirements effectively. This is especially useful for blending a large amount of paint or coating materials.

When there is a need to wash or clean the blender 15 or the paint drum 20, the jaws 141 of the chuck 14 may be loosened to remove the blender 15. The wheel 182 may also be turned to move the movable plank 165 outwards so that clamp apparatus may be removed from the paint drum 20. All this makes washing and cleaning of the blender 15 and the paint drum 20 much easier.

What is claimed is:

1. A straddle mixer, comprising:

a motor driving a blender located thereunder;

a base dock located below the motor having at least one sleeve located respectively at a front side and a rear side on a lower section thereof to couple with a rod;

a clamp apparatus mounted onto the two rods having a stationary plank connected to one end of the rods and a movable plank movably coupled with another end of the rods, and an anchor block fastened to another end of the rods on an outer side of the movable plank;

a screw rod transversely running through the anchor block having an inner end engaged with the movable plank and an outer end engaged with a wheel; and a paint drum having a top end to support the rods, the base dock and the clamp apparatus in a straddle manner.

2. The straddle mixer of claim 1 further having a speed reducer connected to a lower end of the motor, the speed reducer having an output spindle coupled with a hollow coupling barrel, the coupling barrel running through an opening formed on the base dock and being fastened to the base dock, the coupling barrel and the spindle being interposed by a bearing, the spindle having a lower end connected to a chuck which has three jaws.

3. The straddle mixer of claim 1, wherein the stationary plank and a front plank of the movable plank have respectively an inner side with a groove formed thereon to clamp a top peripheral rim of the paint drum.

4. The straddle mixer of claim 1, wherein the movable plank has a front plank and a rear plank coupled together, the rear plank having a transverse fish eye cavity, the inner end of the screw rod running through the fish eye cavity to form a retain flange located in the rear plank and the outer end of the screw rod running through the anchor block to engage with the wheel.

* * * * *